US012102137B1

(12) United States Patent
Jean-Pierre, Sr.

(10) Patent No.: US 12,102,137 B1
(45) Date of Patent: Oct. 1, 2024

(54) SHIRT RETAINING DEVICE

(71) Applicant: Claudel Jean-Pierre, Sr., Queens Village, NY (US)

(72) Inventor: Claudel Jean-Pierre, Sr., Queens Village, NY (US)

( * ) Notice: Subject to any disclaimer, the term of this patent is extended or adjusted under 35 U.S.C. 154(b) by 79 days.

(21) Appl. No.: 18/080,831

(22) Filed: Dec. 14, 2022

(51) Int. Cl.
*A41B 1/10* (2006.01)
*A44C 11/00* (2006.01)

(52) U.S. Cl.
CPC ..... *A41B 1/10* (2013.01); *A44C 11/00* (2013.01)

(58) Field of Classification Search
CPC .. A41B 1/10; A44C 11/00; A44B 6/00; A44B 5/002; Y10T 24/312; Y10T 24/1924; Y10T 24/19; Y10T 24/3485
See application file for complete search history.

(56) References Cited

U.S. PATENT DOCUMENTS 2,123,790 A * 7/1938 Mix ..... A44B 5/002 24/102 PL
2,665,465 A * 1/1954 Albrecht ..... A44B 5/02 24/97
3,688,350 A * 9/1972 Feldman ..... A44B 5/002 24/90.5
4,114,234 A * 9/1978 Hogenson ..... A45C 7/0045 16/114.1
5,007,139 A * 4/1991 Ahern ..... A41D 25/003 24/49.1
7,086,123 B2 * 8/2006 Carter ..... A44C 1/00 24/72.1
8,863,315 B1 10/2014 Sanders
9,060,571 B2 * 6/2015 Hykamp ..... E05B 19/00
9,526,283 B1 12/2016 Jorgenson

* cited by examiner

*Primary Examiner* — Robert Sandy
(74) *Attorney, Agent, or Firm* — Sanchelima & Associates, P.A.; Christian Sanchelima; Jesus Sanchelima

(57) ABSTRACT

A shirt retaining assembly including a chain assembly, a shirt button connector assembly and a buttonhole connector assembly. Chain assembly includes a chain, wherein the chain is a jewelry chain with an S-shape connector attached in and edge thereof. Shirt button connector assembly includes a round member attached to the S connector, wherein the round member has a circular shape that can be placed underneath a shirt button. Buttonhole connector assembly includes a post attached to the opposite side of the chain, wherein the toggle is attached vertically aligned the post by means of a free end. The toggle can be introduced in a buttonhole allowing the shirt to keep stable while unbuttoned.

1 Claim, 3 Drawing Sheets

SHIRT RETAINING DEVICE

1. FIELD OF THE INVENTION

The present invention relates to a retaining device and, more particularly, to a shirt retaining device that includes a chain with two shirt button connectors at one end and one toggle member at the opposite end, which have a suitable shape to be attached in a button shirt and a buttonhole.

2. DESCRIPTION OF THE RELATED ART

Several designs for shirt retaining devices have been designed in the past. None of them, however, include a chain assembly with a distal end attachable to a button shirt and with another distal end attachable to the corresponding buttonhole to maintain the shirt unbuttoned while preventing from being blown open.

Applicant believes that a related reference corresponds to U.S. Pat. No. 9,526,283 issued for a method of securing a necktie using a tile link. Applicant believes that another related reference corresponds to U.S. Pat. No. 8,863,315 issued for decorative collar stay system. None of these references, however, teach of a chain assembly which attaches to a button and corresponding buttonhole located on the front of a button up shirt which is used to maintain the shirt in an opened, unbuttoned configuration while preventing the shirt from moving or being blown open by the wind.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an accessory that fits to any shirt or coat keeping it stable while unbuttoned.

It is another object of this invention to provide a comfortable and stylish accessory that does not oppress.

It is still another object of the present invention to provide an accessory that fits in any shirt or coat that includes shirt buttons with buttonholes.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
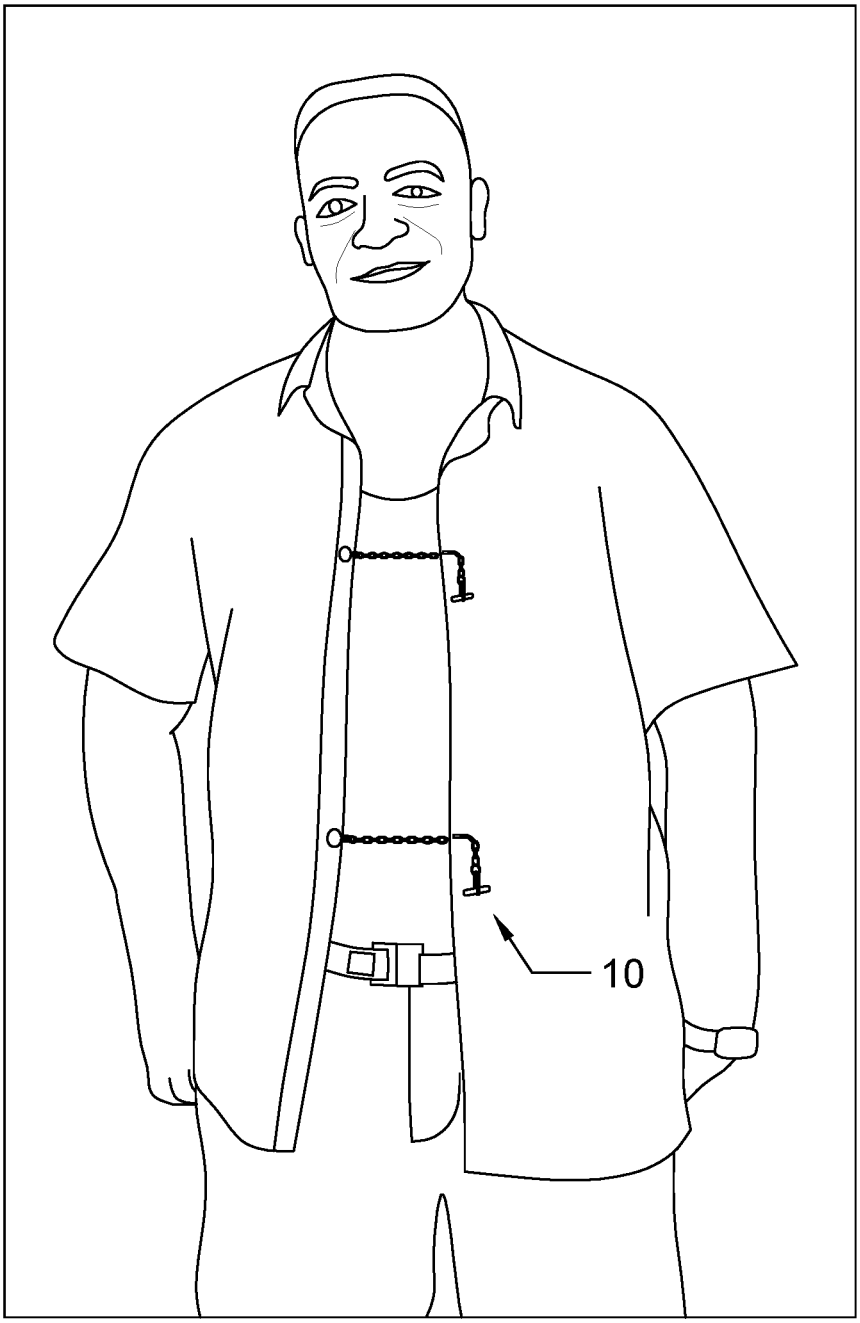
FIG. 1 represents an operational view of an exemplary embodiment of the present invention 10, wherein a plurality thereof may be placed on any shirt button 100 of the garment.

Referring now to the drawings, where the present invention is generally referred to with numeral 10, it can be observed that it basically includes a chain assembly 20, a shirt button connector assembly 40, a buttonhole connector assembly 60 and various exemplary embodiments (100) thereof. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
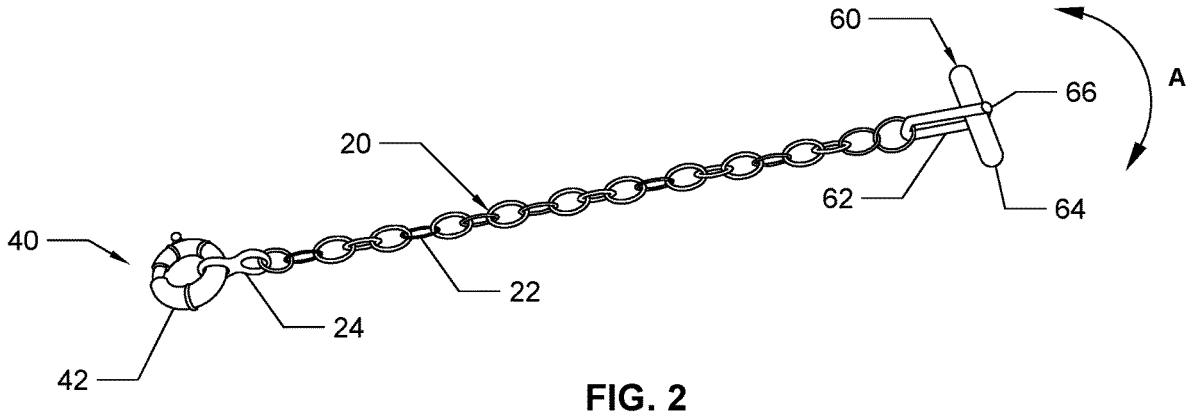
FIG. 2 shows an isometric view of the chain assembly 20, shirt button connector assembly 40 and buttonhole connector assembly 60 connected therebetween.

Chain assembly 20 includes a chain 22 and a connector 24. In an exemplary embodiment, the chain 22 is a serial assembly of connected links, wherein the chain 22 may be a jewelry chain. In a suitable embodiment, the chain 22 may be a bead type, a cable type, a rope type, rolo type or any other variation thereof. The chain 22 may be made of gold, silver, palladium or any other precious metal. Nonetheless, it should be considered that other materials like steel, copper, polymer material may be suitable for chain 22. In one embodiment, the chain 22 may have a suitable length wherein an edge thereof may be placed parallel to a shirt button 100 and the opposite edge may pass through a buttonhole 102 of a shirt, a jacket or any other open body garment while opened. Best depicted in FIG. 1. In one embodiment, connector 24 may be a link with a S-shape, wherein the connector 24 may have two openings. The connector 24 may be made of in one solid piece, nevertheless the connector 24 may include an aperture, wherein the aperture may be tensioned to increase the area of the openings to couple an edge of the chain 22 and may be compressed to close the aperture to secure the chain 22. As shown in FIG. 2. In a suitable embodiment, the connector 24 may be made of gold, silver, palladium or any other precious metal. Nonetheless, it should be considered that other materials like steel, copper, polymer material may be suitable for the connector 24.

Shirt button connector assembly 40 includes a round member 42. In a preferred embodiment, the round member 42 may have a ring-shaped, whereas the round member 42, may have a central area smaller than a circumference of a shirt button 100. In one embodiment, round member 42 may be made of gold, silver, palladium or any other precious metal. Nonetheless, it should be considered that other materials like steel, copper, polymer material may be suitable for the connector 24. In a suitable embodiment, the circumference of the round member 42 may be equal to the shirt button 100. Nevertheless, it should be considered that the connector 24 may have a smaller circumference than the shirt button 100. It should be considered that round member 42 may have a square shape, an oval shape, a regular shape, an irregular shape or any other suitable shape with a central hole may be suitable for the connector 24. In a preferred embodiment, the round member 42 may have a suitable shape to be coupled to the connector 24. In an exemplary embodiment, round member 42 may have a hollow body with a clasp in a portion thereof, the round member 42 further includes a lever that extends past from the periphery of the round member 42, wherein in a portion of the periphery of the round member 42 has an aperture, where the lever can slide along said aperture to open and close the clasp. As FIG. 2 illustrates. The clasp closes may have a spring-loaded clasp that opens when sliding the lever and closes automatically when releasing the pressure on the lever, thereby the round member is removably attached from the garment by opening the gasp and inserting the round member 42 behind the shirt button.

Buttonhole connector assembly 60 includes a post 62, a toggle 64 and a free end 66. In a preferred embodiment, the post 62 may have a rectangular U-shape, having a base with two supports at the edges of the base, wherein the size of the post 62 may be suitable for an opposite edge of the chain 22 may be inserted from an aperture at the top of the post 62 and abutting against the base thereof. In other embodiment, a free end 66 may be pin with a cylindrical shape, a rectangular shape, a square shape or any other suitable shape. The free end 66 is attached to an inner portion of the supports of the post 62 proximal to the aperture and parallel to the base thereof. In an exemplary embodiment, the toggle 64 may have a capsule-shaped with an opening placed in a centered portion thereof, wherein the opening extends past through the body of the toggle 64 and is placed perpendicular with respect to the length of the toggle 64. Preferably, the toggle 64 may be placed between the supports of the post 62 and parallel to thereof, wherein the free end 66 is placed through the opening of the toggle 64. In a suitable embodiment, the opening circumference of the toggle 64 may be bigger than the circumference of the free end 66, whereas the length of the post 62 may be bigger than the half length of the toggle 64 permitting a free rotation thereof.

Figure 3:
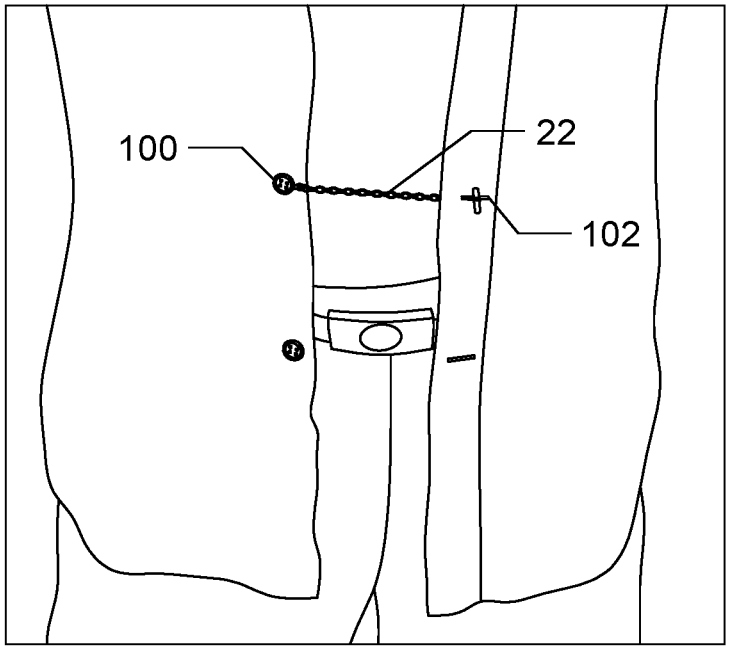
FIG. 3 illustrates a front operational view of the present invention 10 while a toggle 64 is buttoned to the buttonhole 102.
Figure 4:
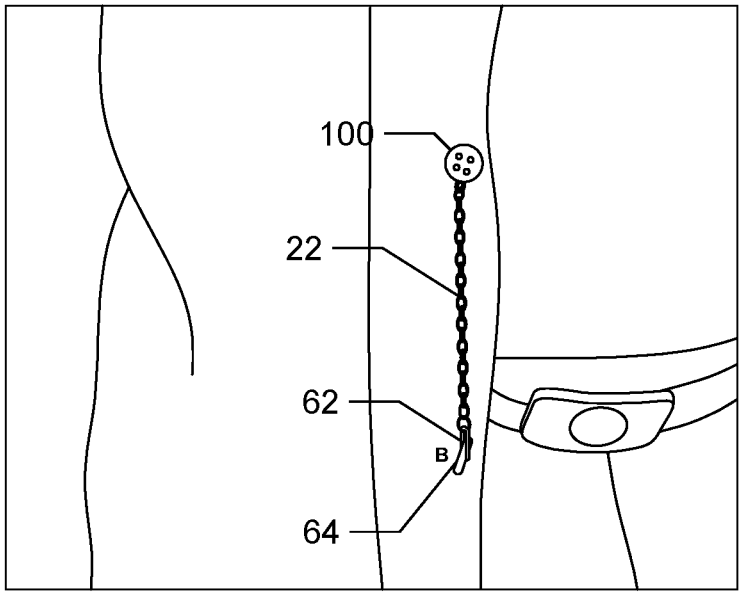
FIG. 4 is a representation of a front operational view of the present invention 10 while shirt button connector assembly 40 is placed underneath a shirt button 100 and the buttonhole connector assembly 60 is unbuttoned.

Referring to the Figures, in one more example of embodiments, the round member 42 may be placed between a preferred shirt button 100 and the garment by sliding the lever an inserting the thread of the stich inside the center area of the round member 42, wherein the buttonhole connector assembly 60 may slide through a preferred buttonhole 102 of the garment, then rotating the toggle to a perpendicular position with respect to the buttonhole 102 to hold the sides of the garment together while opened. Best depicted in FIG. 3. In other exemplary variation, the toggle 64 may rotate to a parallel position with respect to the buttonhole 100 so the buttonhole connector assembly 60 may slide out from the garment, wherein the shirt retaining device stays attached to the garment by means of the round member coupling. As shown in FIG. 4. The buttonhole connector assembly 60 may slide in or slide out from the buttonhole 102 when a user considers appropriate.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shirt retaining device, consisting of:

a chain assembly including a chain and a connector, said chain is a jewelry chain with a suitable length to being placed from a shirt button to a buttonhole of a garment while opened, wherein said connector has a solid body with a S-shape, wherein said connector has two openings, wherein one of them receive said an edge of the chain:

a shirt button connector assembly having a round member, wherein said round member has a ring-shape with a central area, said round member is attached to the other opening of said connector, wherein said central area has a smaller circumference than said shirt button circumference, said round member is attached between said shirt button and a garment, wherein by means of a different circumferences sizes between said central area and said shirt button, said round member stays secured on said garment, said round member has a hollow body with a spring-loaded clasp in a portion thereof, said round member further includes a lever that extends past from the periphery of the round member, wherein in a portion of said periphery of said round member has an aperture, wherein said lever slides along said aperture to open and close said spring-loaded clasp; and a buttonhole connector assembly including a post, a toggle and a free end, wherein said post has a U-shape that conforms a base and two supports placed at the edges of said base, wherein said post is attached at the opposite end of said chain, said free end is attached to the supports of said post and oppositely from the edge of said base, said toggle has a capsule-shape, wherein said toggle is attached to said free end by means of an opening included in a central portion of a body of said toggle, wherein said opening has a bigger circumference than a free end circumference, said post has a bigger length than a half of a length of said toggle permitting the toggle to rotate freely.

* * * * *